US010648715B2

(12) United States Patent
Jeong et al.

(10) Patent No.: US 10,648,715 B2
(45) Date of Patent: May 12, 2020

(54) OUTDOOR HEAT EXCHANGER AND AIR CONDITIONER COMPRISING THE SAME

(71) Applicant: LG ELECTRONICS INC., Seoul (KR)

(72) Inventors: Hojong Jeong, Seoul (KR); Jeongseob Shin, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 221 days.

(21) Appl. No.: 15/373,720

(22) Filed: Dec. 9, 2016

(65) Prior Publication Data

US 2017/0167766 A1 Jun. 15, 2017

(30) Foreign Application Priority Data

Dec. 10, 2015 (KR) ..... 10-2015-0176183

(51) Int. Cl.
*F25B 39/00* (2006.01)
*F25B 13/00* (2006.01)
(Continued)

(52) U.S. Cl.
CPC ..... *F25B 39/00* (2013.01); *F25B 13/00* (2013.01); *F25B 39/028* (2013.01); *F25B 39/04* (2013.01);
(Continued)

(58) Field of Classification Search
CPC ... F28D 1/0408; F28D 1/0435; F28D 1/05325
See application file for complete search history.

(56) References Cited

U.S. PATENT DOCUMENTS

2002/0174673 A1* 11/2002 Wilkinson ..... F24D 5/12 62/260
2011/0056668 A1* 3/2011 Taras ..... F28D 1/0478 165/174
2014/0165628 A1* 6/2014 Tamura ..... F25B 47/022 62/80

FOREIGN PATENT DOCUMENTS

EP 2 674 717 12/2013
JP 2012-172938 9/2012
(Continued)

OTHER PUBLICATIONS

European Search Report dated Apr. 6, 2017 issued in Application No. 16203187.6.
(Continued)

*Primary Examiner* — Ljiljana V. Ciric
*Assistant Examiner* — Alexis K Cox
(74) *Attorney, Agent, or Firm* — KED & Associates LLP

(57) ABSTRACT

An outdoor heat exchanger includes a passage of a refrigerant that has a length varied depending on an operational mode. The outdoor heat exchanger is included in an air conditioner and configured to operate as a condenser in a cooling operation of the air conditioner and as an evaporator in a heating operation of the air conditioner. The outdoor heat exchanger includes a plurality of plates, a plurality of first refrigerant tubes, a plurality of second refrigerant tubes, and a plurality of third refrigerant tubes. In the cooling operation, a condensed refrigerant flows in the plurality of first refrigerant tubes, the plurality of second refrigerant tubes, and the plurality of third refrigerant tubes. In the heating operation, an evaporated refrigerant flows in the plurality of first refrigerant tubes and the plurality of third refrigerant tubes, but does not flow in the plurality of second refrigerant tubes.

14 Claims, 5 Drawing Sheets

(51) Int. Cl.

| | |
|---|---|
| ***F28F 1/32*** | (2006.01) |
| ***F28D 1/047*** | (2006.01) |
| ***F28D 1/04*** | (2006.01) |
| ***F25B 39/02*** | (2006.01) |
| ***F25B 39/04*** | (2006.01) |
| *F28D 21/00* | (2006.01) |

(52) U.S. Cl.
CPC ..... *F28D 1/0435* (2013.01); *F28D 1/0477* (2013.01); *F28F 1/32* (2013.01); *F25B 2500/01* (2013.01); *F28D 2021/007* (2013.01); *F28D 2021/0071* (2013.01)

(56) References Cited

FOREIGN PATENT DOCUMENTS

| | | |
|---|---|---|
| JP | 2012-184893 | 9/2012 |
| KR | 10-2004-0060068 | 7/2004 |
| KR | 10-2006-0067543 | 6/2006 |
| WO | WO 2015/063989 | 5/2015 |

OTHER PUBLICATIONS

Korean Notice of Allowance dated May 27, 2017 issued in Application No. 10-2015-0176183.

* cited by examiner

OUTDOOR HEAT EXCHANGER AND AIR CONDITIONER COMPRISING THE SAME

CROSS-REFERENCE TO RELATED APPLICATION

This application claims the priority benefit of Korean Patent Application No. 10-2015-0176183, filed on Dec. 10, 2015, in the Korean Intellectual Property Office, the disclosure of which is incorporated herein by reference.

BACKGROUND OF THE INVENTION

1. Field of the Invention

The present invention relates to an outdoor heat exchanger and an air conditioner comprising the same, and, more particularly, to an outdoor heat exchanger, in which the length of a passage of a refrigerant is varied depending on an operational mode, and an air conditioner comprising the outdoor heat exchanger.

2. Description of the Related Art

In general, an air conditioner is an apparatus configured to include a compressor, an outdoor heat exchanger, an expansion valve, and an indoor heat exchanger and to cool or heat the interior of a room using a refrigerating cycle. That is, the air conditioner may include a cooler for cooling the interior of a room and a heater for heating the interior of a room. The air conditioner may also be formed of a combination cooling and heating air conditioner for cooling or heating the interior of a room.

If the air conditioner is formed of the combination cooling and heating air conditioner, the air conditioner further includes a 4-way valve for changing the passage of a refrigerant, compressed by the compressor, depending on a cooling operation or a heating operation. That is, in the cooling operation, the refrigerant compressed by the compressor flows in the outdoor heat exchanger through the 4-way valve, and the outdoor heat exchanger functions as a condenser. Next, the refrigerant condensed by the outdoor heat exchanger is expanded by the expansion valve, and the condensed refrigerant flow in the indoor heat exchanger. In this case, the indoor heat exchanger functions as an evaporator. Next, the refrigerant evaporated by the indoor heat exchanger flows in the compressor through the 4-way valve.

Meanwhile, in the heating operation, the refrigerant compressed by the compressor flows in the indoor heat exchanger through the 4-way valve, and the indoor heat exchanger functions as a condenser. Next, the refrigerant condensed by the indoor heat exchanger is expanded by the expansion valve, and the expanded refrigerant flows in the outdoor heat exchanger. In this case, the outdoor heat exchanger functions as an evaporator. Next, the refrigerant evaporated by the outdoor heat exchanger flows in the compressor through the 4-way valve.

However, due to the length of a passage of a refrigerant, there is difference in pressure loss between an outdoor heat exchange operating as a condenser and an outdoor heat exchange operating as an evaporator. Thus, it is necessary to change the length of the passage.

SUMMARY OF THE INVENTION

It is another object of the present invention to provide an outdoor heat exchanger, in which the length of a passage of a refrigerant is varied depending on an operational mode, and an air conditioner comprising the outdoor heat exchanger.

Objects of the present invention should not be limited to the aforementioned object and other unmentioned objects will be clearly understood by those skilled in the art from the following description.

In accordance with an embodiment of the present invention, the above and other objects can be accomplished by the provision of an outdoor heat exchanger included in an air conditioner, the outdoor heat exchanger including a plurality of first refrigerant tubes aligned in a single row, a plurality of second refrigerant tubes aligned in a single row while being spaced apart from the plurality of first refrigerant tubes, and a plurality of third refrigerant tubes aligned in a single row while being spaced apart from the plurality of first refrigerant tubes, wherein, in the cooling operation, a condensed refrigerant flows in the plurality of first refrigerant tubes, the plurality of second refrigerant tubes, and the plurality of third refrigerant tubes, and wherein, in the heating operation, an evaporated refrigerant flows in the plurality of first refrigerant tubes and the plurality of third refrigerant tubes, but does not flow in the plurality of second refrigerant tubes.

The details of other embodiments are included in the following description and the accompanying drawings.

BRIEF DESCRIPTION OF THE DRAWINGS

The embodiments will be described in detail with reference to the following drawings in which like reference numerals refer to like elements wherein.

DETAILED DESCRIPTION OF THE PREFERRED EMBODIMENTS

Merits and characteristics of the present invention and methods for achieving them will become more apparent from the following embodiments taken in conjunction with the accompanying drawings. However, the present invention is not limited to the disclosed embodiments, but may be implemented in various ways. The embodiments are provided to complete the disclosure of the present invention and to allow those having ordinary skill in the art to fully understand the scope of the present invention. The present invention is defined by the category of the claims. The same reference numbers will be used throughout the drawings to refer to the same or like parts.

Hereinafter, embodiments of an outdoor heat exchanger and an air conditioner including the same will be described in detail with reference to the accompanying drawings for describing an outdoor heat exchanger.

Figure 1:
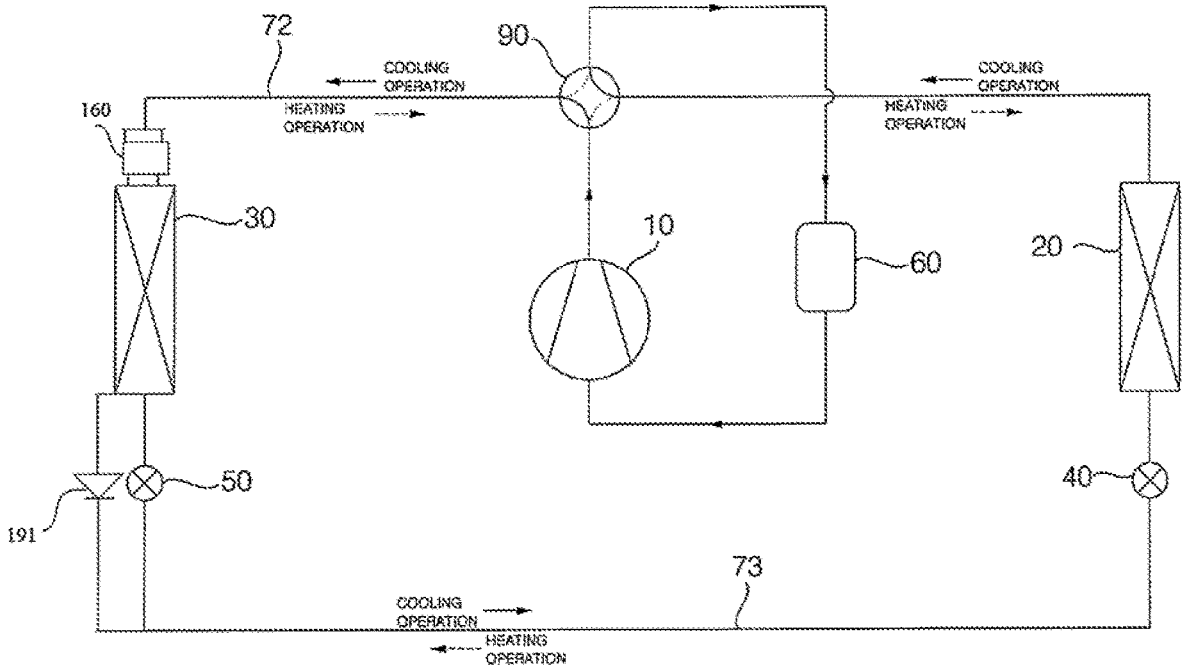
FIG. 1 is a schematic diagram illustrating the construction of an air conditioner according to an embodiment of the present invention.

FIG. 1 is a diagram illustrating the construction of an air conditioner according to an embodiment of the present invention.

The air conditioner according to an embodiment of the present invention includes: a compressor 10 configured to a refrigerant; an outdoor heat exchanger 30 disposed in an outdoor space and configured to exchange heat between a refrigerant and outdoor air; an indoor heat exchanger 20 disposed in an indoor space and configured to exchange heat between a refrigerant and indoor air; and a switching unit 90 configured to guide a refrigerant, discharged from the compressor 10, to the indoor heat exchanger 20 in a heating operation or to the outdoor heat exchanger in a cooling operation.

The compressor 10 compresses a refrigerant of low temperature and low pressure into a refrigerant of high temperature and high pressure. The compressor 10 may be in various structures, and the compressor 10 may be a reciprocating compressor including a cylinder and a piston or may be a scroll compressor including an orbiting scroll and a fixed scroll. In some embodiments, there may be provided a plurality of compressors 10.

A refrigerant evaporated by the outdoor heat exchanger 30 flows into the compressor 10 in a heating operation, whereas a refrigerant evaporated by the indoor heat exchanger 20 flows into the compressor 10 in a cooling operation.

In this embodiment, the heating operation is an operational mode for heating indoor air by compressing a refrigerant in the indoor heat exchanger 20, and the cooling operation is an operational mode for cooling down indoor air by evaporating a refrigerant in the indoor heat exchanger 20.

A vapor-liquid separator 60 separates a refrigerant, flowed into the compressor 10, into refrigerant vapor and refrigerant liquid. The vapor-liquid separator 60 separates a refrigerant, which is evaporated by the outdoor heat exchanger 30 in a heating operation or which is a evaporated by the indoor heat exchanger 20 in a cooling operation, into refrigerant vapor and refrigerant liquid. The vapor-liquid separator 60 is provided between the switch unit 90 and the compressor 10. The refrigerant vapor separated by the vapor-liquid separator 60 flows into the compressor 10.

The switching unit 90 is a flow switching valve for switching between heating and cooling operations. The switching unit 90 guides a refrigerant, compressed by the compressor, to the indoor heat exchanger 20 in a heating operation and to the outdoor heat exchanger 30 in a cooling operation.

The switching unit 90 is connected to the compressor 10, the vapor-liquid separator 60, the indoor heat exchanger 20, and the outdoor heat exchanger 30. In a heating operation, the switching unit 90 connects the compressor 10 and the indoor heat exchanger 20, and connects the outdoor heat exchanger 30 and the vapor-liquid separator 60. In a cooling operation, the switching unit 90 connects the compressor 10 and the outdoor heat exchanger 30 to each other, and connects the indoor heat exchanger 20 and the vapor-liquid separator 60 to each other.

The switching unit 90 may be implemented as various modules which are capable of connecting different passages to each other. In this embodiment, the switching unit 90 is a 4-way valve. In some embodiments, the switching unit 90 may be implemented as various valves or a combination thereof, such as a combination of two 3-way valves which is capable of switching one of four passages to another.

The outdoor heat exchanger 30 is disposed in an outdoor space, and a refrigerant passing through the outdoor heat exchanger 30 exchanges heat with outdoor air. The outdoor heat exchanger 30 operates as an evaporator in a heating operation to evaporate a refrigerant, while operating as a condenser in a cooling operation to condense a refrigerant.

The outdoor heat exchanger 30 is connected to the switching unit 90, an outdoor expansion valve 50 and/or an indoor expansion valve 40. In the heating operation, a refrigerant expanded by the outdoor expansion valve 50 flows into the outdoor heat exchanger 30. Next, the refrigerant is evaporated by the outdoor heat exchanger 30 and flows into the switching unit 90. In the cooling operation, a refrigerant compressed by the compressor 10 and passing through the switching unit 90 flows into the outdoor heat exchanger 30. Next, the refrigerant is condensed by the outdoor heat exchanger 30, and flows into the outdoor expansion valve 50 or the indoor expansion valve 40.

In the heating operation, a degree of opening of the outdoor expansion valve 50 is adjusted to expand a refrigerant. In the cooling operation, the outdoor expansion valve 50 is fully opened to let a refrigerant pass therethrough, or closed not to let a refrigerant pass therethrough. The outdoor expansion valve 50 is connected to the outdoor heat exchanger 30 and the indoor expansion valve 40.

The outdoor expansion valve 50 expands a refrigerant flowing from the indoor heat exchanger 20 to the outdoor heat exchanger 30. In the cooling operation, the outdoor expansion valve 50 allows a refrigerant, flowing from the outdoor heat exchanger 30, to pass therethrough so that the refrigerant is guided to the indoor expansion valve 40. Alternatively, in the cooling operation, the outdoor expansion valve 50 does not allow a refrigerant to pass therethrough.

The indoor heat exchanger 20 is disposed in an indoor space, and a refrigerant passing through the indoor heat exchanges heat with indoor air. The indoor heat exchanger 20 operates as a condenser in a heating operation to condense a refrigerant, and operates as an evaporator in a cooling operation to evaporate a refrigerant.

The indoor heat exchanger 20 is connected to the switching unit 90 and the indoor expansion valve 40. In a heating operation, a refrigerant compressed by the compressor 10 and passing through the switching unit 90 flows into the indoor heat exchanger 20. Next, the refrigerant is condensed by the indoor heat exchanger 20 and then flows into the indoor expansion valve 40. In a cooling operation, a refrigerant expanded by the indoor expansion valve 40 flows into the indoor heat exchanger 20. Next, the refrigerant is evaporated by the indoor heat exchanger 20 and then discharged to the switching unit 90.

In the heating operation, the indoor expansion valve 40 is fully opened to let a refrigerant pass therethrough. In the cooling operation, a degree of opening of the indoor expansion valve 40 is controlled to expand a refrigerant. The indoor expansion valve 40 is connected to the indoor heat exchanger 20, the outdoor expansion valve 50 and/or the outdoor heat exchanger 30.

In the heating operation, the indoor expansion valve 40 allows a refrigerant, flowing from the indoor heat exchanger 20, to pass therethrough so that the refrigerant is guided to the outdoor expansion valve 50. In the cooling operation, the indoor expansion valve 40 expands a refrigerant which flows from the outdoor heat exchanger 20 to the indoor heat exchanger 20.

An outdoor pipe 72 connects the outdoor heat exchanger 30 and the switching unit 90. In the heating operation, the outdoor pipe 72 guides a refrigerant, evaporated by the outdoor heat exchanger 30, to the switching unit 90. In the cooling operation, the outdoor pipe 72 guides a refrigerant, compressed by the compressor 10 and passing through the switching unit 90, to the outdoor heat exchanger 30.

An liquid line 73 connects the indoor expansion valve 40 to the outdoor expansion valve 50 or to the outdoor heat exchanger 30. In the heating operation, the liquid line 73 guides a refrigerant, which is condensed by the indoor heat exchanger 20 and passes through the indoor expansion valve 40, to the outdoor expansion valve 50. In the cooling operation, the liquid line 73 guides a refrigerant, which is condensed by the outdoor heat exchanger 30 or which is condensed by the outdoor heat exchanger 30 and passes through the outdoor expansion valve 50, to the indoor expansion value 40.

Figure 2:
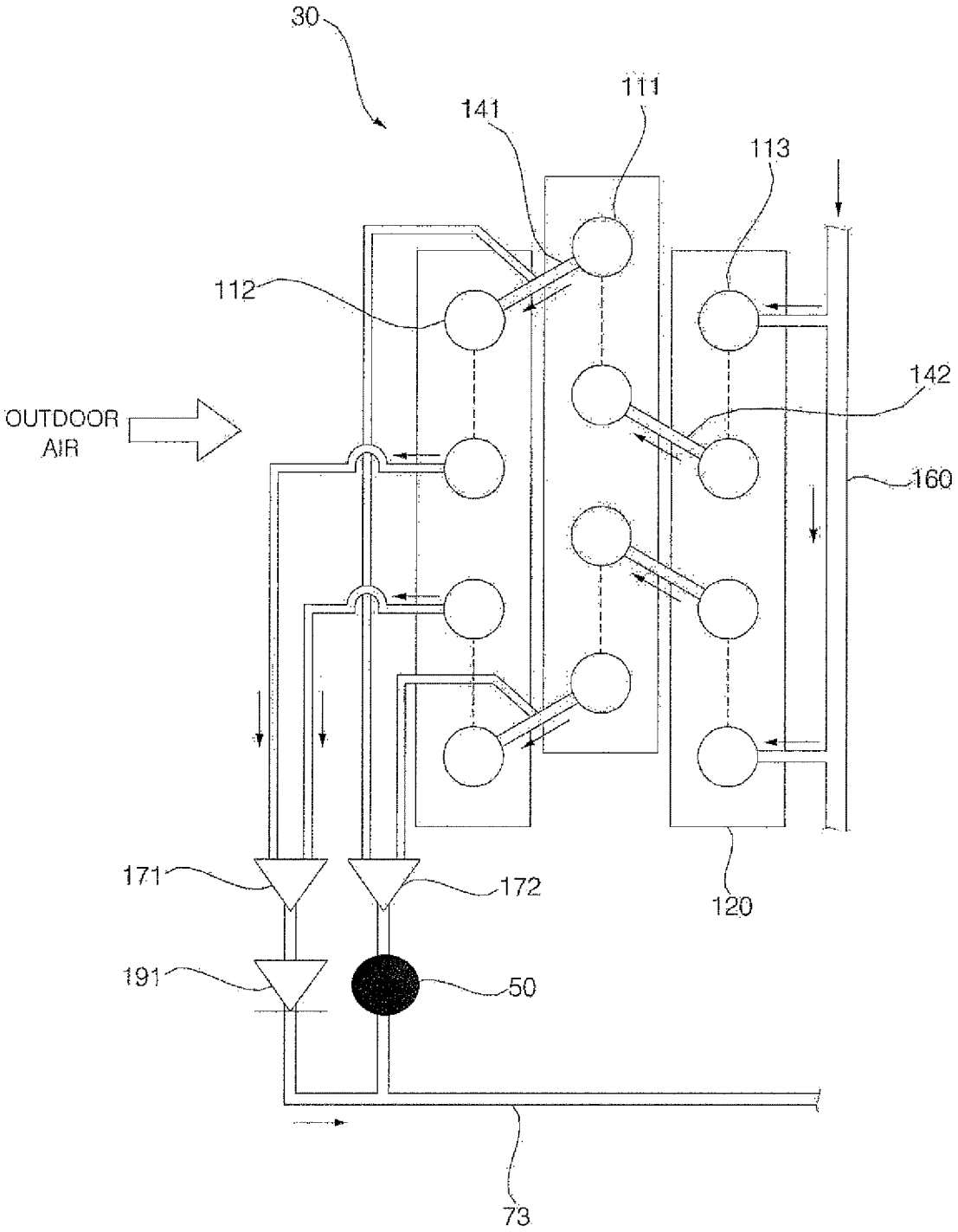
FIG. 2 is a schematic diagram illustrating a flow of refrigerant through an outdoor heat exchanger in a cooling operation according to an embodiment.
Figure 3:
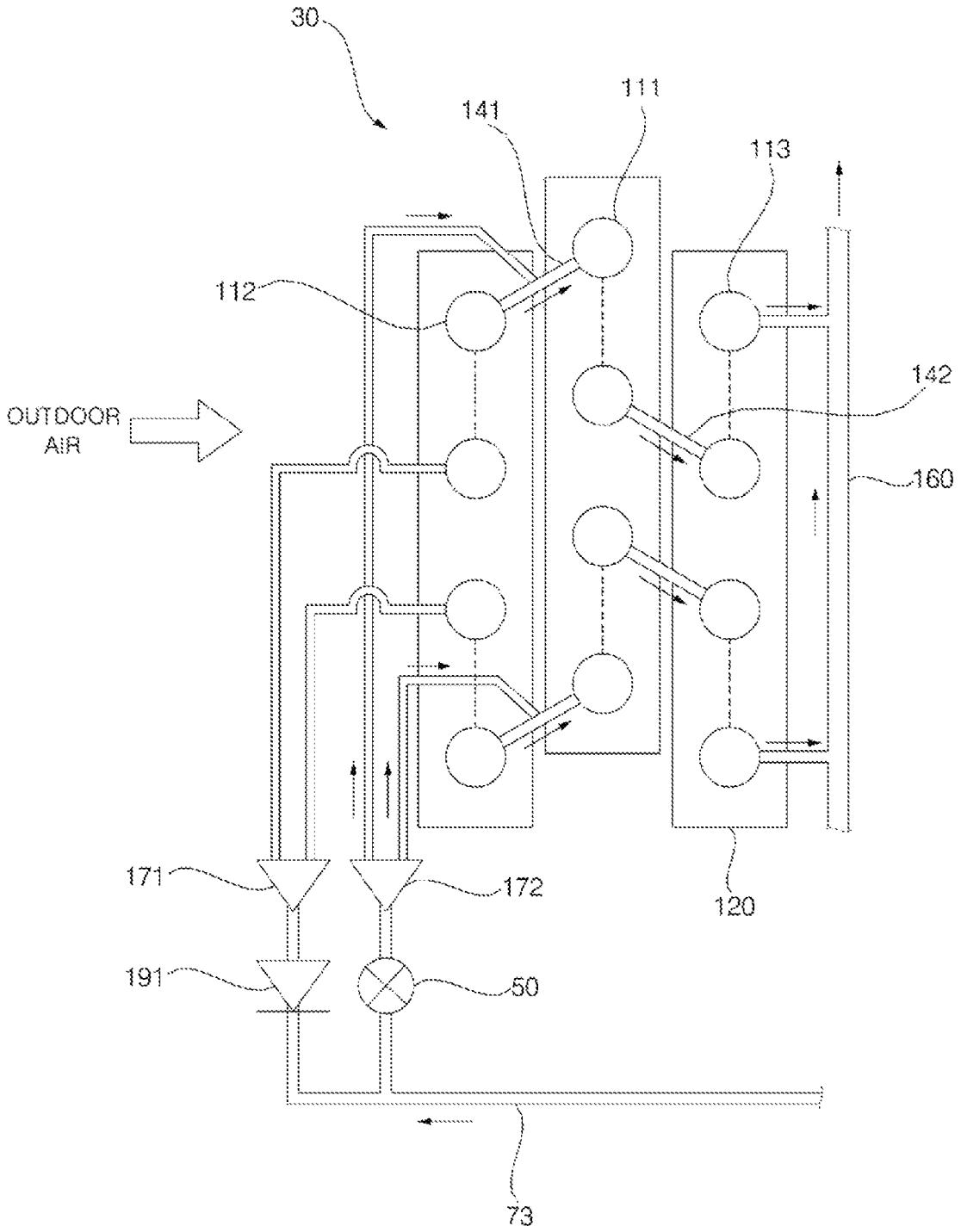
FIG. 3 is a schematic diagram illustrating a flow of refrigerant through an outdoor heat exchanger in a heating operation according to an embodiment.

FIGS. 2 and 3 are diagrams illustrating the construction of an outdoor heat exchanger according to an embodiment of the present invention. FIG. 2 shows the flow of a refrigerant in a cooling operation of an outdoor heat exchanger according to an embodiment of the present invention, and FIG. 3 shows the flow of a refrigerant in a heating operation of an outdoor heat exchanger according to an embodiment of the present invention.

The outdoor heat exchanger 30 according to an embodiment of the present invention includes: a plurality of plates 120, a plurality of first refrigerant tubes 111 penetrating the plurality of plates 120 and aligned in a single row; a plurality of second refrigerant tubes 112 penetrating the plurality of plates 120 and aligned in a single row while being spaced apart from the plurality of first refrigerant tubes 112; and a plurality of third refrigerant tubes 113 penetrating the plurality of plates 120 and aligned in a single row while being spaced apart from the plurality of first refrigerant tubes 111.

The plurality of plates 120 exchanges heat with outdoor air. The plurality of plates 120 receives and transfers heat with respect to the plurality of refrigerant tubes 111, the plurality of second refrigerant tubes 112, and/or the plurality of third refrigerant tubes 113, so that a refrigerant flowing in the plurality of refrigerant tubes 111, the plurality of second refrigerant tubes 112, and/or the plurality of third refrigerant tubes 113 may exchange heat with outdoor air. In a case where the outdoor heat exchanger 30 operates as an evaporator 30, the plurality of plates 120 receives heat of the outdoor air and delivers the heat of the outdoor air to the refrigerant flowing in the plurality of refrigerant tubes 111, the plurality of second refrigerant tubes 112, and/or the plurality of third refrigerant tubes 113. In a case where the outdoor heat exchanger 30 operates as a condenser, the plurality of plates 120 receives heat from a refrigerant flowing in the plurality of refrigerant tubes 111, the plurality of second refrigerant tubes 112, and/or the plurality of third refrigerant tubes 113, and transfers the heat to outdoor air.

Each of the plurality of plates 120 is in a plate shape and aligned in parallel with one another. Each of the plurality of plates 120 is aligned to be orthogonal to respective straight portions of the plurality of first refrigerant tubes 111, the plurality of second refrigerant tubes 112, and/or the plurality of third refrigerant tubes 113. The plurality of plates 120 are spaced apart from each other in a direction orthogonal to a flow direction of the outdoor air in order to allow outdoor air to flow between the plurality of the plates 120. It is desirable that the plurality of refrigerant tubes 111, the plurality of second refrigerant tubes 112, and the plurality of third refrigerant tubes 113 all penetrate a single plate 120. In some embodiments, however, the plurality of plates 120 may consist of a plurality of first plates penetrated by the plurality of first refrigerant tubes 111, a plurality of second plates penetrated by the plurality of second refrigerant tubes 112, and a plurality of plates penetrated by the plurality of third refrigerant tubes 113.

Each of the plurality of the first refrigerant tubes 111 is in the form of a U-shaped pipe, and a straight portion of the pipe penetrates the plurality of plates 120. The plurality of first refrigerant tubes 111 is aligned in a single row, while being spaced apart from each other orthogonally to a flowing direction of outdoor air. The plurality of first refrigerant tube 111 is connected to the plurality of second refrigerant tubes 112 via a plurality of first return bands 141. The plurality of first refrigerant tubes 111 is connected to the plurality of third refrigerant tubes 113 via a plurality of second return bands 142.

A condensed refrigerant flows in the plurality of first refrigerant tubes 111 in a cooling operation, whereas an evaporated refrigerant flows therein in a heating operation. In the cooling operation, a refrigerant flowing in the plurality of first refrigerant tubes 111 is condensed by exchanging heat with outdoor air, and flows into the plurality of second refrigerant tubes 112 through the plurality of first return bans 141. In the heating operation, a refrigerant flowing in the plurality of first refrigerant tubes 111 is evaporated by exchanging heat with outdoor air, and flows into the plurality of third refrigerant tubes 113 through the plurality of second return bands 142.

Each of the plurality of second refrigerant tubes 112 is in the form of a U-shaped pipe, and a straight portion of the pipe penetrates the plurality of plates 120. The plurality of second refrigerant tubes 112 are aligned in a single row, while being spaced apart from each other orthogonally to a flow direction of outdoor air. The plurality of second refrigerant tubes 112 are aligned in a single row in a direction in which the plurality of first refrigerant tubes 111 are aligned. The plurality of second refrigerant tubes 112 is connected to the plurality of first refrigerant tubes 111 via the plurality of first return bands 141. The plurality of second refrigerant tubes 112 is connected to a condensation header pipe 171.

A condensed refrigerant flows in the plurality of second refrigerant tubes 112 in a cooling operation, whereas a refrigerant does not flow therein in a heating operation. In the cooling operation, the refrigerant flowing in the plurality of second refrigerant tubes 112 is condensed by exchanging heat with outdoor air, and then flows into the condensation header pipe 171.

Each of the plurality of third refrigerant tubes 113 is in the form of a U-shaped pipe, and a straight portion of the pipe penetrates the plurality of plates 120. The plurality of third refrigerant tubes 113 is aligned in a single row, while being spaced apart from each other orthogonally to a flow direction of outdoor air. The plurality of third refrigerant tubes 113 is aligned in a single row in a direction in which the plurality of first refrigerant tubes 111 are aligned. The plurality of third refrigerant tubes 113 is connected to a plurality of first refrigerant tubes 111 via the plurality of second return bands 142. The plurality of third refrigerant tubes 113 is connected to a distribution module 160.

A condensed refrigerant flows in the plurality of third refrigerant tubes 113 in a cooling operation, whereas an evaporated refrigerant flows therein in a heating operation. In the cooling operation, a refrigerant flowing in the plurality of third refrigerant tubes 113 is condensed by exchanging heat with outdoor air, and then flows into the plurality of first refrigerant tubes 111 through the plurality of second return bands 142. In the heating operation, a refrigerant flowing in the plurality of third refrigerant tubes 113 is evaporated by exchanging heat with outdoor air, and then flows into the distribution module 160.

In a cooling operation, a condensed refrigerant are flowing in the plurality of first refrigerant tubes 111, the plurality of second refrigerant tubes 112, and the plurality of third refrigerant tubes 113. In a heating operation, an evaporated refrigerant flows in the plurality of first refrigerant tubes 111 and the plurality of third refrigerant tubes 113, but does not flow in the plurality of refrigerant tubes 112.

The plurality of first refrigerant tubes 111 is aligned in a single row, the plurality of second refrigerant tubes 112 is aligned in a single row, and the plurality of third refrigerant tubes 113 is aligned in a single row. With reference to a flow direction of outdoor air, the plurality of second refrigerant tubes 112 is disposed in the front of the plurality of first refrigerant tubes 111, and the plurality of third refrigerant tubes 113 is disposed in the rear of the plurality of first refrigerant tubes 111.

Tue plurality of first return bands 141 connects the plurality of first refrigerant tubes 111 and the plurality of second refrigerant tubes 112. The plurality of first return bands 141 is connected to an evaporation header pipe 172. The plurality of second return bands 142 connects the plurality of first refrigerant tubes 111 and the plurality of third refrigerant tubes 113.

The distribution module 160 is connected to an outdoor pipe 72. The distribution module 160 is connected to the plurality of third refrigerant tubes 113.

In a cooling operation, the distribution module 160 supplies a refrigerant, which is compressed by the compressor 10 and passes through the switching unit 90 and then the outdoor pipe 72, to the plurality of third refrigerant tubes 113. In a heating operation, a refrigerant, supplied from the evaporation header pipe 172 and passing through the plurality of first return bands 141, the plurality of first refrigerant tubes 111, the plurality of second return bands 142, and the plurality of third refrigerant tube 113, flows into the distribution module 160. That is, in the heating operation, a refrigerant evaporated by the plurality of first refrigerant tubes 111 and the plurality of third refrigerant tubes 113 flows into the distribution module 160.

The condensation header pipe 171 is connected to the plurality of second refrigerant tubes 112. The condensation header pipe 171 is connected to the liquid line 73. A check valve 191 is provided between the condensation header pipe 171 and the liquid line 73, and prevents a refrigerant from flowing from the liquid line 73 to the condensation header pipe 171.

In a cooling operation, a refrigerant, supplied from the distribution module 160 and passing through the plurality of third refrigerant tubes 113, the plurality of second return bands 142, the plurality of first refrigerant tubes 111, the plurality of first return bands 141, and the plurality of second refrigerant tubes 112, flows into the condensation header pipe 171. That is, in the cooling operation, a refrigerant condensed by the plurality of third refrigerant tubes 113, the plurality of first refrigerant tubes 111, and the plurality of second refrigerant tubes 112 flows into the condensation header pipe 171. In a heating operation, a refrigerant does not flow in the condensation header pipe 171.

The evaporation header pipe 172 is connected to the plurality of first return bands 141. The evaporation header pipe 172 is connected to the liquid line 73. The outdoor expansion valve 50 is provided between the evaporation header pipe 172 and the liquid line 73. In a heating operation, the evaporation header pipe 172 supplies a refrigerant expanded by the outdoor expansion valve 50 to the plurality of first return bands 141. In a cooling operation, the outdoor expansion valve 50 is closed, and thus, a refrigerant does not flow in the evaporation header pipe 172.

With reference to FIGS. 1 and 2, there is provided descriptions of how an outdoor heat exchanger according to an embodiment of the present invention operates in a cooling operation.

A refrigerant compressed by the compressor 10 passes through the switching unit 90 and the outdoor pipe 72, and then flows into the distribution module 160 of the outdoor heat exchanger 30. The refrigerant flowing in the distribution module 160 is condensed by passing through the plurality of third refrigerant tubes 113, the plurality of second return bands 142, the plurality of first refrigerant tubes 111, the plurality of first return bands 141, and the plurality of second refrigerant tubes 112, and the condensed refrigerant flows into the condensation header pipe 171. The refrigerant flowed into the condensation header pipe 171 flows into the indoor expansion valve 40 through the check valve 191 via the liquid line 73. The refrigerant flowed into the indoor expansion valve 40 is expanded therein and evaporated by the indoor heat exchanger 20, and then flows into the vapor-liquid separator 60 through the switching unit 90. Refrigerant vapor separated by the vapor-liquid separator 60 flows into the compressor 10 and then compressed again.

With reference to FIGS. 1 to 3, there is provided description of how an outdoor heat exchanger according to an embodiment of the present invention operates in a heating operation.

A refrigerant compressed by the compressor 10 flows into the indoor heat exchanger 20 through the switching unit 90. The refrigerant flowed into the indoor heat exchanger 20 is compressed therein and flows into the outdoor expansion valve 50 through the indoor expansion valve 40 via the liquid line 73. The refrigerant flowed into the outdoor expansion valve 50 is expanded therein and flows into the evaporation header pipe 172 of the outdoor heat exchanger 30.

The refrigerant flowed into the evaporation header pipe 172 is evaporated by passing through the plurality of first return bands 141, the plurality of first refrigerant tubes 111, the plurality of second return bands 142, and the plurality of third refrigerant tubes 113, and the evaporated refrigerant flows into the distribution module 160. In a heating operation, a refrigerant flows in the plurality of first refrigerant tubes 111 and the plurality of third refrigerant tubes 113, but does not flow in the plurality of second refrigerant tubes 112. As a result, the length of a passage of a refrigerant is reduced, thereby reducing pressure loss and improving evaporation performance. In addition, the formation of frost may be delayed because an evaporated refrigerant does not flow in the plurality of second refrigerant tubes 112 which is disposed foremost with respect to a direction in which outdoor air flows.

The refrigerant flowed into the distribution module 160 flows into the switching unit 90 through the outdoor pipe 72. The refrigerant flowed into the switching unit 90 flows into the vapor-liquid separator 60, and refrigerant vapor separated by the vapor-liquid separator 60 flows into the compressor 10 and then compressed again.

Figure 4:
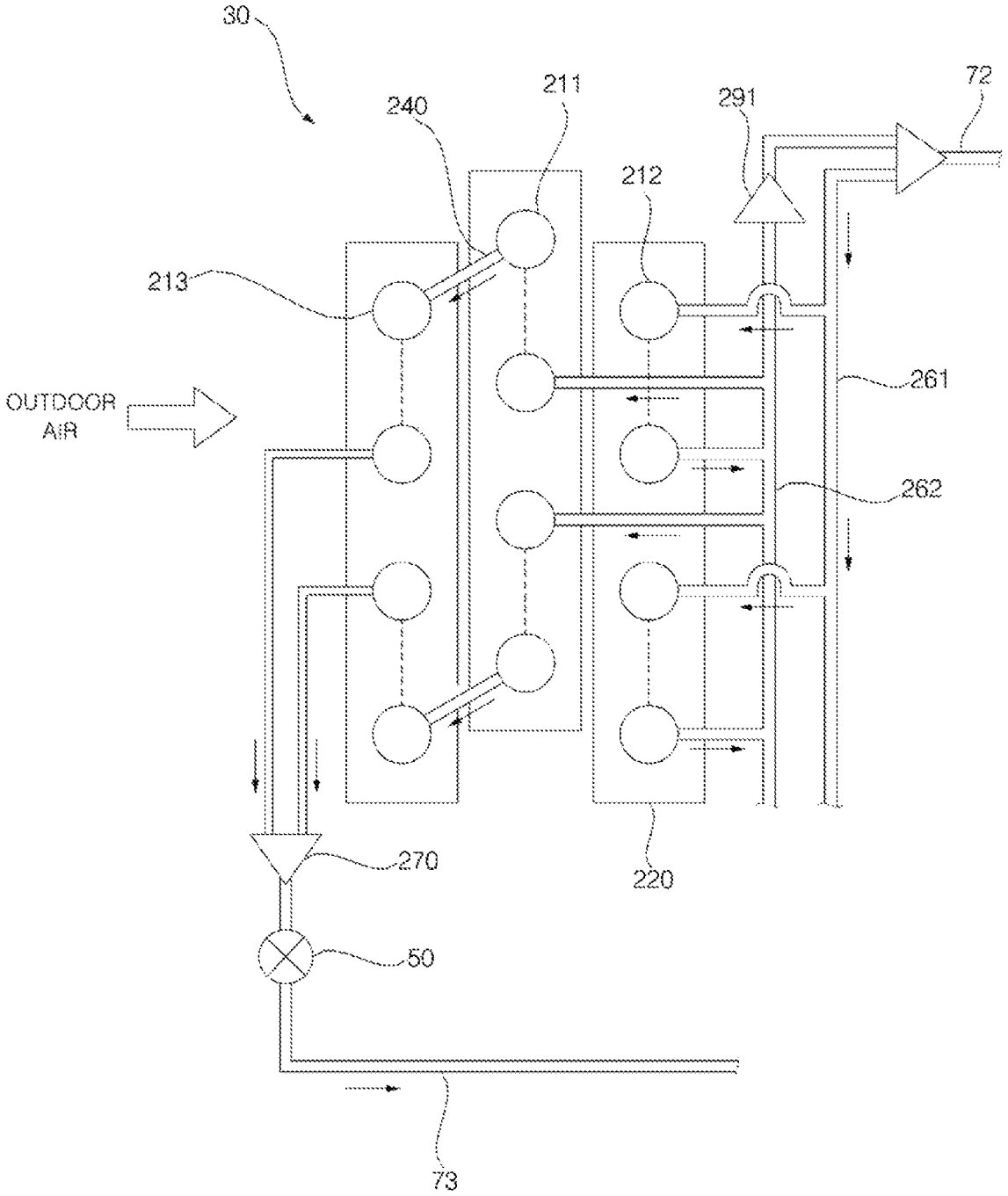
FIG. 4 is a schematic diagram illustrating a flow of refrigerant through an outdoor heat exchanger in a cooling operation according to another embodiment.
Figure 5:
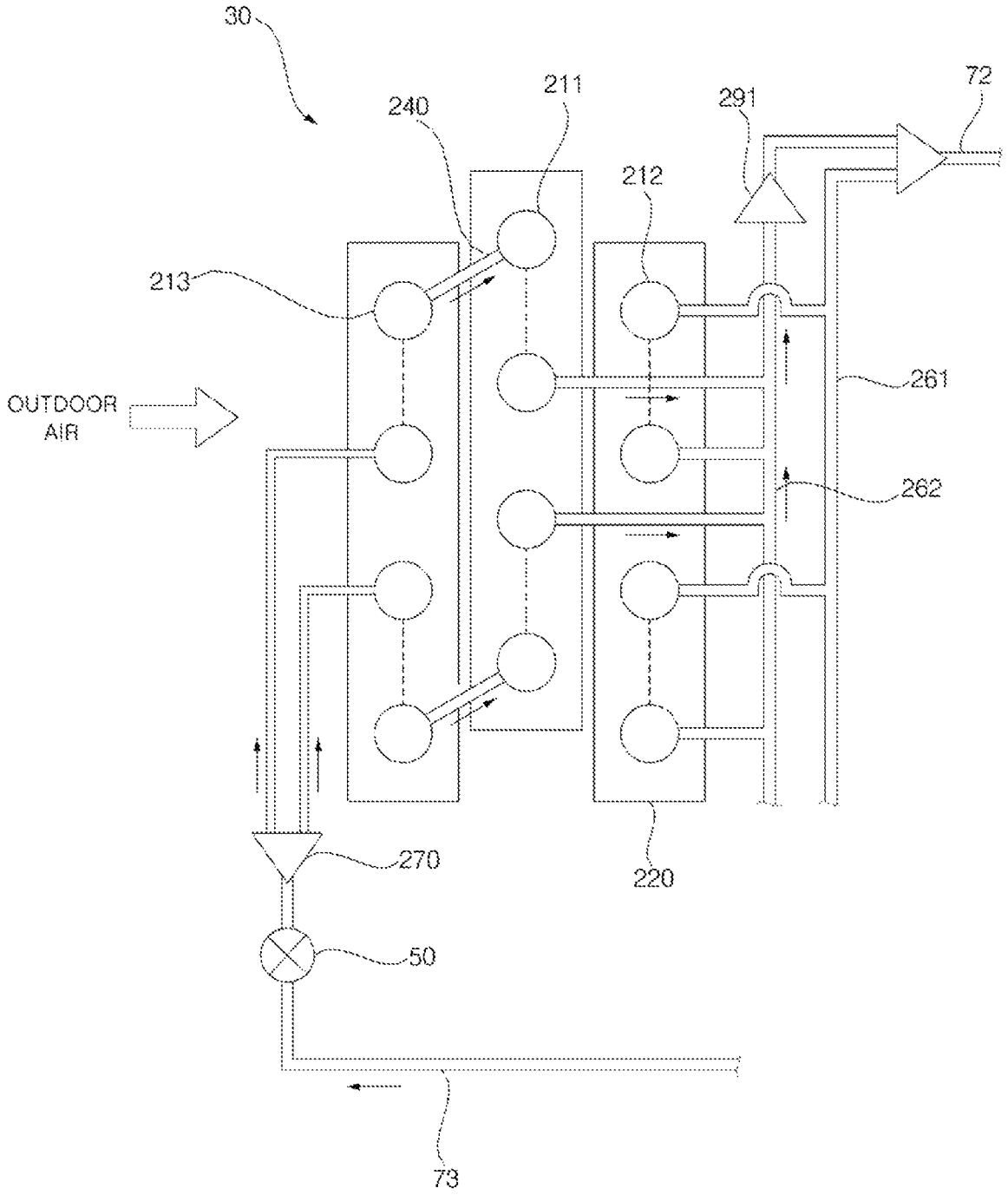
FIG. 5 is a schematic diagram illustrating a flow of refrigerant through an outdoor heat exchanger in a heating operation according to the embodiment exemplified in FIG. 4.

FIGS. 4 and 5 are diagrams illustrating the construction of an outdoor heat exchanger according to another embodiment of the present invention. FIG. 4 is a diagram showing the flow of a refrigerant in a cooling operation of an outdoor heat exchanger according to another embodiment of the present invention, and FIG. 5 is a diagram showing the flow of a refrigerant in a heating operation of an outdoor heat exchanger according to another embodiment of the present invention.

An outdoor heat exchanger 30 according to another embodiment of the present invention includes: a plurality of plates 220, a plurality of first refrigerant tubes 211 penetrating the plurality of plates 220 and aligned in a single row; a plurality of second refrigerant tubes 212 penetrating the plurality of plates 220 and aligned in a single row while being spaced apart from the plurality of first refrigerant tubes 211; and a plurality of third refrigerant tubes 213 penetrating the plurality of plates 220 and aligned in a single row while being spaced apart from the plurality of first refrigerant tubes 211.

The plurality of plates 220 may have the same shape and function as those of the plurality of plates 120, and thus, description thereof is herein omitted.

Each of the plurality of first refrigerant tubes 211 is in the form of a U-shaped pipe, and a straight portion of the pipe penetrates the plurality of plates 220. The plurality of first refrigerant tubes 211 is aligned in a single row, while being spaced apart from each other orthogonally to a flow direction of outdoor air. The plurality of first refrigerant tube 211 is connected to the plurality of second refrigerant tubes 212 via an evaporation distributor 262. The plurality of first refrigerant tubes 211 is connected to the plurality of third refrigerant tubes 213 via a plurality of connection bands 240.

A condensed refrigerant flows in the plurality of first refrigerant tubes 211 in a cooling operation whereas an evaporated refrigerant flows in the plurality of first refrigerant tubes 211 in a heating operation. In the cooling operation, a refrigerant flowing in the plurality of first refrigerant tubes 211 is condensed by exchanging heat with outdoor air, and then flows into the plurality of third refrigerant tubes 213 through the plurality of connection bands 240. In the heating operation, a refrigerant flowing in the plurality of first refrigerant tubes 111 is evaporated by exchanging heat with outdoor air, and then flows into the evaporation distributor 262.

Each of the plurality of second refrigerant tubes 212 is in the form of a U-type pipe, and a straight portion of the pipe penetrates the plurality of plates 220. The plurality of second refrigerant tubes 212 is aligned in a single row, while being spaced apart each other orthogonally to a flow direction of outdoor air. The plurality of second refrigerant tubes 212 is aligned in a single row in a direction in which the plurality of first refrigerant tubes 211 is aligned. The plurality of second refrigerant tubes 212 is connected to the plurality of first refrigerant tubes 211 via the evaporation distributor 262. The plurality of second refrigerant tubes 212 is connected to a condensation distributor 261.

A condensed refrigerant flows in the plurality of second refrigerant tubes 212 in a cooling operation, whereas a refrigerant does not flow therein in a heating operation. In the cooling operation, the refrigerant flowing in the plurality of second refrigerant tubes 212 is condensed by exchanging heat with outdoor air, and then flows into the plurality of first refrigerant tubes 211 via the evaporation distributor 262.

Each of the plurality of third refrigerant tubes 213 is in the form of a U-type pipe, and a straight portion of the pipe penetrates the plurality of plates 220. The plurality of third refrigerant tubes 213 is aligned in a single row, while being separated from each other orthogonally to a flow direction of outdoor. The plurality of third refrigerant tubes 213 is connected to the plurality of first refrigerant tubes 211 via the connection bands 240. The plurality of third refrigerant tubes 213 is connected to a header module 270.

A condensed refrigerant flows in the plurality of third refrigerant tubes 213 in a cooling operation, whereas an evaporated refrigerant flows therein in a heating operation. In the cooling operation, the refrigerant flowing in the plurality of third refrigerant tubes 213 is condensed by exchanging heat with outdoor air, and then flows into the header module 270. In the heating operation, the refrigerant flowing in the plurality of third refrigerant tubes 213 is evaporated by changing heat with outdoor air, and then flows into the plurality of first refrigerant tubes 211 via the connection bands 240.

In a cooling operation, a condensed refrigerant flows in the plurality of first refrigerant tubes 211, the plurality of second refrigerant tubes 212, and the plurality of third refrigerant tubes 213. In a heating operation, an evaporated refrigerant flows in the plurality of first refrigerant tubes 211 and the plurality of third refrigerant tubes 213, but does not flow in the plurality of second refrigerant tubes 212.

The plurality of first refrigerant tubes 211 are aligned in a single row, the plurality of second refrigerant tubes 212 are aligned in a single row, and the plurality of third refrigerant tubes 213 are aligned in a single row. With respect to a flow direction of outdoor air, the plurality of second refrigerant tubes 212 are disposed in the rear of the plurality of first refrigerant tubes 211, and the plurality of third refrigerant tubes 213 are disposed in the front of the plurality of first refrigerant tubes 211.

The connection bands 240 connect the plurality of first refrigerant tubes 211 and the plurality of third refrigerant tubes 213.

The header module 270 is connected to the plurality of third refrigerant tubes 213. The header module 270 is connected to a liquid line 73. An outdoor expansion valve 50 is provided between the header module 270 and the liquid line 73.

In a cooling operation, a refrigerant, supplied from the condensation distributor 261 and passing through the plurality of second refrigerant tubes 212, the evaporation distributor 262, the plurality of first refrigerant tubes 211, the connection bands 240, and the plurality of third refrigerant tubes 213, flows into the header module 270. That is, in the cooling operation, a refrigerant condensed by the plurality of second refrigerant tubes 212, the plurality of first refrigerant tubes 211, and the plurality of third refrigerant tubes 213 flows into the header module 270. In a heating operation, the header module 270 supplies a refrigerant expanded by the outdoor expansion valve 50 to the plurality of third refrigerant tubes 213.

The condensation distributor 261 is connected to an outdoor pipe 72. The condensation distributor 261 is connected to the plurality of second refrigerant tubes 212. In a cooling operation, the condensation distributor 261 supplies a refrigerant, compressed by the compressor 20 and flowed into the condensation distributor 261 through the switch unit 90, to the plurality of second refrigerant tubes 212 through the outdoor pipe 72. In a heating operation, a refrigerant does not flow in the condensation distributor 261.

The evaporation distributor 262 is connected to the outdoor pipe 72. The evaporation distributor 262 is connected to the plurality of second refrigerant tubes 212 and the plurality of first refrigerant tubes 211. That is, the evaporation distributor 262 connects the plurality of second refrigerant tubes 212 and the plurality of first refrigerant tubes 211. Between the evaporation distributor 262 and the outdoor pipe 72, there is provided a backflow prevention valve 291 which is configured to prevent refrigerants from flowing from the outdoor pipe 72 to the evaporation distributor 262.

In a cooling operation, the evaporation distributor 262 guides a refrigerant, condensed by the plurality of second refrigerant tubes 212, toward the plurality of first refrigerant tubes 211. A refrigerant passing through the plurality of third refrigerant tubes 213, the plurality of connection bands 240, and the plurality of first refrigerant tubes 211 flows into the evaporation distributor 262. That is, a refrigerant evaporated by the plurality of third refrigerant tubes 213 and the plurality of first refrigerant tubes 211 flows into the evaporation distributor 262.

With reference to FIGS. 1 to 4, there is provided description of how an outdoor heat exchanger according to another embodiment of the present invention operates in a cooling operation.

A refrigerant compressed by the compressor 10 flows into the condensation distributor 261 of the outdoor heat exchanger 30 through the switch unit 90 via the outdoor pipe 72. The refrigerant flowed into the condensation distributor 261 is condensed by passing through the plurality of second refrigerant tubes 212, the evaporation distributor 262, the plurality of first refrigerant tubes 211, the connection bands 240, and the plurality of third refrigerant tubes 213, and the condensed refrigerant flows into the header module 270. The refrigerant flowed into the header module 270 flows into an indoor expansion valve 40 through a fully-opened outdoor expansion valve 50 via the liquid line 73. The refrigerant flowed into the indoor expansion valve 40 is expanded and evaporated by an indoor heat exchanger 20, and flows into a vapor-liquid separator 60 through the switch unit 90. Refrigerant vapor separated by the vapor-liquid separator 60 flows into the compressor 10 and then compressed again.

With reference to FIGS. 1 to 5, there is provided description of how an outdoor heat exchanger according to another embodiment of the present invention operates in a heating operation.

The refrigerant compressed by the compressor 10 flows into the indoor heat exchanger 20 through the switch unit 90. The refrigerant flowed into the indoor heat exchanger 20 is condensed, and then flows into the outdoor expansion valve 50 through the indoor expansion valve 40 via the liquid line 73. The refrigerant flowed into the outdoor expansion valve 50 is expanded, and then flows into the header module 270 of the outdoor heat exchanger 20.

The refrigerant flowed into the header module 270 is evaporated by passing through the plurality of third refrigerant tubes 213, the plurality of connection bands 240, and the plurality of first refrigerant tubes 211, and the evaporated refrigerant flows into the evaporation distributor 262. In a heating operation, a refrigerant in the plurality of first refrigerant tubes 211 and the plurality of third refrigerant tubes 213, but does not flow in the plurality of second refrigerant tubes 212. As a result, the length of a passage of a refrigerant is reduced, thereby reducing pressure loss and improving evaporation performance.

The refrigerant flowed into the evaporation distributor 262 flows into the switch unit 90 through the backflow prevention valve 90 via the outdoor pipe 72. The refrigerant flowed into the switch unit 90 flows into the vapor-liquid separator 60. Refrigerant vapor separated by the vapor-liquid separator 60 flows into the compressor 10 and then compressed again.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternatives uses will also be apparent to those skilled in the art.

Embodiments of an outdoor heat exchanger according to the present invention and an air conditioner comprising the same have one or more effects as below.

First, it may minimize pressure loss of a refrigerant in an outdoor heat exchanger during a heating operation, thereby improving evaporation performance.

Second, it is possible to change the length of a passage of a refrigerant according to an operational mode, without changing the structures of refrigerant tubes and plates of an existing outdoor heat exchanger.

Third, it is possible to delay the formation of frost in a heating operation.

Effects of the present invention should not be limited to the aforementioned effects and other unmentioned effects will be clearly understood by those skilled in the art from the claims.

What is claimed is:

1. An outdoor heat exchanger comprising:

a plurality of plates;

a plurality of first refrigerant tubes penetrating the plurality of plates and aligned in a single row;

a plurality of second refrigerant tubes penetrating the plurality of plates and aligned in a single row while being spaced apart from the plurality of first refrigerant tubes;

a plurality of third refrigerant tubes penetrating the plurality of plates and aligned in a single row while being spaced apart from the plurality of first refrigerant tubes;

a plurality of first return bands directly connecting the plurality of first refrigerant tubes and the plurality of second refrigerant tubes, but not directly connecting the plurality of first refrigerant tubes and the plurality of third refrigerant tubes;

a plurality of second return bands directly connecting the plurality of first refrigerant tubes and the plurality of third refrigerant tubes, but not directly connecting the plurality of second refrigerant tubes and the plurality of third refrigerant tubes;

a distribution module connected to the plurality of third refrigerant tubes;

a condensation header pipe connected to the plurality of second refrigerant tubes; and an evaporation header pipe connected to the plurality of first return bands, wherein the distribution module is configured such that, when the distribution module supplies a refrigerant to the plurality of third refrigerant tubes, the refrigerant is condensed when it flows in the plurality of first refrigerant tubes, the plurality of second refrigerant tubes, the plurality of third refrigerant tubes, and the first and second return bands, and condensed refrigerant flows into the condensation header pipe, wherein the evaporation header pipe is configured such that, when the evaporation header pipe supplies a refrigerant to the plurality of first return bands, the refrigerant is evaporated when it flows in the plurality of first refrigerant tubes, the plurality of third refrigerant tubes, and the first and second return bands, and evaporated refrigerant that flows into the distribution module does not flow in the plurality of second refrigerant tubes, and wherein the plurality of second refrigerant tubes is provided at a front of the plurality of first refrigerant tubes, and the plurality of third refrigerant tubes is provided at a rear of the plurality of first refrigerant tubes, the rear of the plurality of first refrigerant tubes being at a side at which the distribution module is provided and the front of the plurality of first refrigerant tubes being at a side opposite to the rear of the plurality of first refrigerant tubes.

2. The outdoor heat exchanger of claim 1, wherein, when a refrigerant is condensed in at least one of the pluralities of first, second, or third refrigerant tubes, the outdoor heat exchanger is in a cooling mode; and wherein, when a refrigerant is evaporated in at least one of the pluralities of first or third refrigerant tubes, the outdoor heat exchanger is in a heating mode.

3. The outdoor heat exchanger of claim 1, wherein the pluralities of first, second, and third refrigerant tubes all penetrate a first plate of the plurality of plates.

4. The outdoor heat exchanger of claim 1, wherein the plurality of first refrigerant tubes penetrate a first plate of the plurality of plates, the plurality of second refrigerant tubes penetrate a second plate of the plurality of plates, and the plurality of third refrigerant tubes penetrate a third plate of the plurality of plates.

5. The outdoor heat exchanger of claim 1, wherein each of the tubes in the pluralities of first, second, and third refrigerant tubes is formed in a U-shaped pipe, and a straight portion of each of the tubes penetrates the plurality of plates.

6. The outdoor heat exchanger of claim 1, wherein the distribution module is directly connected to the plurality of third refrigerant tubes but is not directly connected to the plurality of first refrigerant tubes or the plurality of second refrigerant tubes, and the plurality of third refrigerant tubes are provided between the plurality of first refrigerant tubes and the distribution module.

7. An air conditioner configured to perform each of a cooling operation and a heating operation, comprising:

a compressor to compress a refrigerant;

an indoor heat exchanger provided in an indoor space to exchange heat between indoor air and a refrigerant;

an outdoor heat exchanger provided in an outdoor space to exchange heat between outdoor air and a refrigerant;

a switching valve configured such that, in a cooling operation, guides the refrigerant compressed by the compressor to the outdoor heat exchanger by connecting the compressor to the outdoor heat exchanger and that, in a heating operation, guides the refrigerant compressed by the compressor to the indoor heat exchanger by connecting the compressor to the indoor heat exchanger, and an outdoor expansion valve configured to expand a refrigerant condensed by the indoor heat exchanger in the heating operation, wherein the outdoor heat exchanger comprises:

a plurality of plates;

a plurality of first refrigerant tubes penetrating the plurality of plates and aligned in a single row;

a plurality of second refrigerant tubes penetrating the plurality of plates and aligned in a single row while being spaced apart from the plurality of first refrigerant tubes;

a plurality of third refrigerant tubes penetrating the plurality of plates and aligned in a single row while being spaced apart from the plurality of first refrigerant tubes;

a plurality of first return bands directly connecting the plurality of first refrigerant tubes and the plurality of second refrigerant tubes;

a plurality of second return bands separate from the first return bands and directly connecting the plurality of first refrigerant tubes and the plurality of third refrigerant tubes;

a distribution module connected to the plurality of third refrigerant tubes;

a condensation header pipe connected to the plurality of second refrigerant tubes; and an evaporation header pipe connected to the plurality of first return bands, wherein the distribution module is configured such that, in the cooling operation, the distribution module supplies a refrigerant to the plurality of third refrigerant tubes, and the refrigerant is condensed when it passes through the plurality of third refrigerant tubes, the plurality of second return bands, the plurality of first refrigerant tubes, the plurality of first return bands, and the plurality of second refrigerant tubes, and the plurality of third refrigerant tubes, and the condensed refrigerant flows into the condensation header pipe, wherein the evaporation header pipe is configured such that, in the heating operation, the evaporation header pipe supplies a refrigerant to the plurality of first return bands, and the refrigerant is evaporated when it passes through the plurality of first refrigerant tubes, the plurality of second return bands, and the plurality of third refrigerant tubes, and the evaporated refrigerant flows into the distribution module without flowing in the plurality of second refrigerant tubes, and wherein the plurality of second refrigerant tubes is provided at a front of the plurality of first refrigerant tubes, and the plurality of third refrigerant tubes is provided at a rear of the plurality of first refrigerant tubes, the rear of the plurality of first refrigerant tubes being a side at which the distribution module is provided and the front of the plurality of first refrigerant tubes being a side opposite to the rear.

8. The air conditioner according to claim 7, further comprising a check valve provided between the condensation header pipe and the indoor heat exchanger, and that prevents a refrigerant from flowing from the indoor heat exchanger to the condensation header pipe without first flowing through the outdoor heat exchanger.

9. The air conditioner according to claim 7, wherein the outdoor expansion valve is configured to be closed in the cooling operation.

10. The air conditioner of claim 7, further including:

a vapor-liquid separator that separates vapor refrigerant from liquid refrigerant;

an indoor expansion valve;

an outdoor pipe that connects the outdoor heat exchanger to the switching valve; and a liquid line that connects the indoor expansion valve to the outdoor expansion valve, wherein, the switching valve is connected to the compressor, the vapor-liquid separator, the indoor heat exchanger, and the outdoor heat exchanger, and wherein the outdoor pipe is connected to the distribution module and the liquid line is connected to the evaporation header pipe and the condensation header pipe.

11. A heat exchange assembly, including:

a plurality of first refrigerant tubes provided between and spaced apart from a plurality of second refrigerant tubes and a plurality of third refrigerant tubes;

a plurality of first return bands directly connecting the plurality of first and second refrigerant tubes;

a plurality of second return bands directly connecting the plurality of first and third refrigerant tubes;

a plurality of plates penetrated by the pluralities of the first, second, and third refrigerant tubes;

a distribution module connected to the plurality of third refrigerant tubes;

a condensation header pipe connected to the plurality of second refrigerant tubes; and an evaporation header pipe connected to the plurality of first return bands, wherein a first refrigerant flow path is formed from the distribution module to the condensation header pipe through the first, second, and third pluralities of refrigerant tubes, wherein a second refrigerant flow path is formed from the evaporation header pipe to the distribution module through the first and third refrigerant tubes, but not through the second refrigerating tube, and wherein the plurality of second refrigerant tubes is provided at a front of the plurality of first refrigerant tubes, and the plurality of third refrigerant tubes is provided at a rear of the plurality of first refrigerant tubes, the rear of the plurality of first refrigerant tubes being a side at which the distribution module is provided and the front of the plurality of first refrigerant tubes being a side opposite to the rear.

12. The heat exchange assembly of claim 11, wherein there is no pipe connecting the second plurality of refrigerant tubes directly to the third plurality of refrigerant tubes, and wherein the first and second return bands are not directly joined.

13. The heat exchange assembly of claim 11, further including:

a check valve that allows refrigerant to flow from the condensation heater pipe through the check valve, but prevents refrigerant from flowing through the check valve to the condensation heater pipe; and an expansion valve connected to the evaporation header pipe.

14. The heat exchange assembly of claim 13, wherein refrigerant introduced into the evaporation header pipe has been expanded by the expansion valve, and wherein refrigerant flowing through the check valve has been heat-exchanged with outdoor air by flowing through the pluralities of first, second, and third refrigerant tubes.

* * * * *